United States Patent [19]

Conde, Sr.

[11] 3,937,468

[45] Feb. 10, 1976

[54] HANDLE FOR A NUNCHAKU DEVICE

[76] Inventor: Francis E. Conde, Sr., 435 Lancaster Ave., Lancaster, Pa. 17603

[22] Filed: Feb. 24, 1975

[21] Appl. No.: 552,661

[52] U.S. Cl. ..... 273/84; 272/76; 273/DIG. 6; 273/DIG. 12

[51] Int. Cl.[2] ..... A63B 59/00

[58] Field of Search..... 273/84, 58 C, 67 R, DIG. 6, 273/DIG. 12, 67, 81.2, 95 A, 184 B, 185 C; 231/1, 2 R, 3–6; 272/74, 75, 76, 57

[56] References Cited

UNITED STATES PATENTS

| | | | |
|---|---|---|---|
| 3,454,274 | 8/1969 | Kaneshiro | 472/76 |
| 3,608,899 | 9/1971 | Hall | 273/84 |

*Primary Examiner*—Richard C. Pinkham
*Assistant Examiner*—T. Brown
*Attorney, Agent, or Firm*—John C. Thompson

[57] ABSTRACT

A nunchaku having two spaced apart rod-like elements or handle members, each element being formed of a plastic insert molded in a body portion which forms the balance of the element. The plastic insert, which is formed on nylon 6/6, has two spaced apart generally parallel apertures extending from one exterior sidewall of the element to the other exterior sidewall, the insert being disposed in one end of the element. The balance of the element is formed of high density polypropylene which is molded about the insert, the body portion having better impact resistance than the insert, and the insert, which receives a cord to secure one element of the nunchaku to another element of the nunchaku, having better wear resistance and greater strength than the high density polypropylene. Each element of the nunchaku is made by holding the plastic insert between intersecting surfaces in the mold cavities of each of two mold halves when the mold halves are brought together into their closed operative position, and by injection molding high density polypropylene, which has a lower melt temperature than the insert, about end surfaces and selected sidewalls of the insert.

5 Claims, 8 Drawing Figures

HANDLE FOR A NUNCHAKU DEVICE

CROSS REFERENCE TO RELATED APPLICATIONS

This application relates to a nunchaku of the type shown in U.S. Design Patent application Ser. No. 533,546 filed Dec. 17, 1974 and entitled DESIGN FOR A NUNCHAKU. A related application is U.S. Patent application Ser. No. 533,515 filed Dec. 17, 1974 and entitled METHOD OF MAKING A MOLDED ASSEMBLY AND A NUNCHAKU MADE IN ACCORDANCE WITH SAID METHOD.

FIELD OF THE INVENTION

The present invention relates generally to an improved construction of an element or handle member of a nunchaku, and to a manner of making the improved element.

BACKGROUND OF THE INVENTION

A nunchaku is an ancient martial arts weapon originally developed in Okinawa. Nunchakus are used today by many practitioners of martial arts such as karate. The nunchakus which are used today are generally made of two rod-like elements or handle member which are interconnected by either a cord or by a chain. Each of the elements is conventionally made of a hard wood such as rock maple and usually has an overall length of 12 or 14 inches (30.5 or 35.5 millimeters) and has a diameter of from 1 to 1 and ¼ inches (2.54 to 3.2 mm.). It has recently been proposed to make the elements of nunchakus of materials other than wood, and the aforementioned Design Patent application Ser. No. 533,546 shows a cord-type nunchaku in which the elements are made entirely of high density polypropylene. Application Ser. No. 533,515 shows a chain type nunchaku also formed principally of high density polypropylene.

It has been found when making the plastic elements of the type shown in the Design Patent application Ser. No. 533,546 that a number of matching operations must be performed on each of the elements. Thus, with the design shown in the aforementioned Design Patent application it is necessary to drill or otherwise form two parallel spaced apart apertures which extend in a direction transverse to the principal axis of the body of the element, to form grooves in the elements of the nunchaku, each groove extending between associated ends of the pair of spaced apart apertures, the grooves being for the purpose of receiving portions of the cord which interconnects one element of the nunchaku to another, and also to further drill a longitudinally extending aperture from one end of the element, the longitudinally extending aperture being adapted to intersect an intermediate portion of the closest aperture of the pair of spaced apart apertures, the purpose of the longitudinally extending aperture also being to receive portions of the cord which is used to interconnect the two elements of a nunchaku.

The foregoing method has several disadvantages. One disadvantage is obviously the required machining of the molded elements. Furthermore, it has been found when molding the elongated rod-like elements that occasionally voids will be found within the molded element. If such a void exists in the area between the pair of spaced apart holes and the grooves, the remaining material, if any, will not have sufficient strength for the desired application, and therefore that particular element will have to be scrapped. Further, it has been found that high density polypropylene, which is the desired material because of its non brittle character and its good solvent resistance, along with its relatively low cost, does not have the desired strength. Thus, that area which lies between the grooves and the pair of spaced apart apertures is occasionally subjected to very high forces during the use of the nunchaku and it is desirable that this area be formed of a material having high strength characteristics. Furthermore, it is also desirable that the surface area which surrounds the longitudinally extending aperture have high wear characteristics so that this surface will not become unduly worn during the operation of the nunchaku.

OBJECTS AND SUMMARY OF THIS INVENTION

It is a principal object of the present invention to provide an improved element of a nunchaku which has a principal body portion with good impact resistance and good resistance to solvents, a longitudinally extending cord receiving aperture surrounded by material having good wearing characteristics, and that portion which is disposed between a pair of spaced apart apertures and a pair of spaced apart grooves having high strength characteristics.

It is a further object of the present invention to provide a method of making an improved element of a nunchaku wherein machining operations are substantially reduced and improved structural characteristics are achieved.

The foregoing objects are accomplished by providing a plastic insert made of nylon 6/6, the insert being provided with a pair of spaced apart transversely extending apertures and grooves extending between the ends of the apertures, by positioning the insert in mold cavities of two mold halves, and then by injection molding high density polypropylene into the mold cavity to substantially encapsulate said plastic insert.

The foregoing objects and other objects and advantages of this invention will be apparent to those skilled in the art after a consideration of the following detailed description taken in conjunction with the accompanying drawings.

DETAILED DESCRIPTION OF A PREFERRED EMBODIMENT

Figure 1:
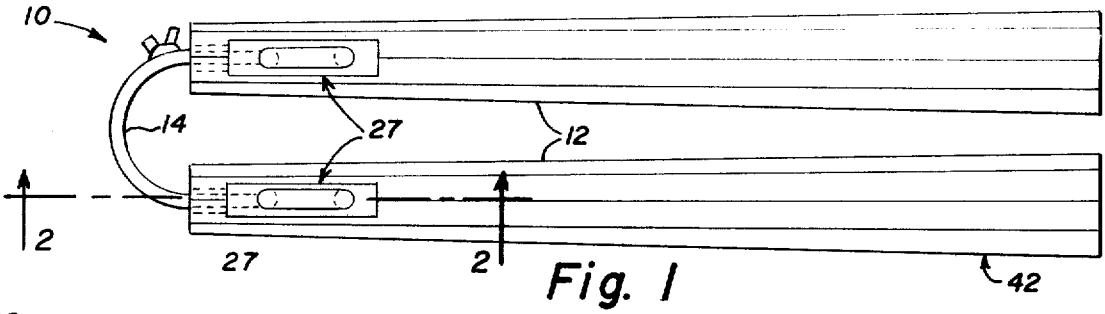
FIG. 1 is a side view of a nunchaku made in accordance with the principals of the present invention.
Figure 2:
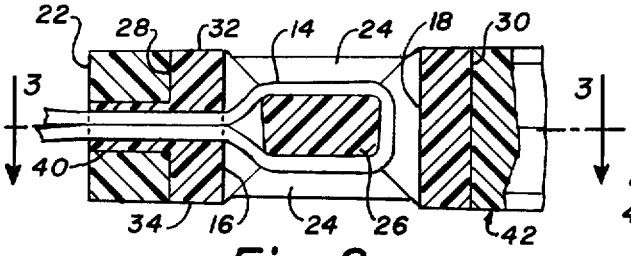
FIG. 2 is an enlarged sectional view taken generally along the line 2 — 2 in FIG. 1.
Figure 3:
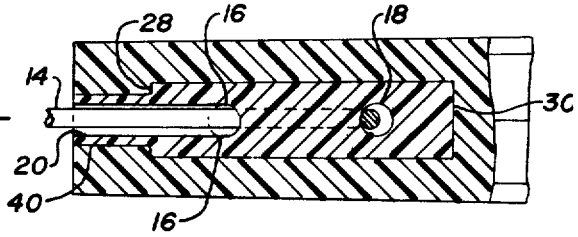
FIG. 3 is a sectional view taken generally along the line 3 — 3 in FIG. 2.
Figure 4:
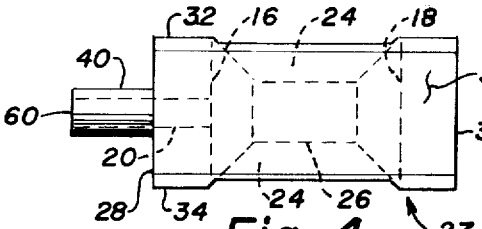
FIGS. 4, 5, and 6 are respectively side, end, and top views of the plastic insert which is incorporated into an element of a nunchaku.

Referring first to FIG. 1, a nunchaku is indicated generally at 10, the nunchaku including two spaced apart rod-like or generally cylindrical handle member or elements 12, the elements being interconnected by a cord 14. The cord is threaded through a pair of generally parallel spaced apart apertures 16, 18 in one end of each of the elements of a nunchaku, the cord also passing through a longitudinally extending aperture 20 which extends from one end 22 of the elements to the adjacent aperture 16 of the pair of parallel spaced apart apertures. The end portion of the nunchaku adjacent said one end 22 is also provided with a pair of recessed areas or grooves 24 which extend from one end of one of the pair of generally parallel spaced apart apertures 16, 18 to the adjacent end of the other aperture, and portions of the cord are adapted to lay within these grooves so that the cord does not project materially above the surface of the element of the nunchaku. The structure thus far described is generally conventional and is found in nunchakus where the elements are made of wood or entirely of one form of synthetic material. As has been brought out above, in these prior art construction after the element has been formed to its exterior shape the apertures are subsequently drilled within the element and the grooves are also formed by machining the surface of the element. This manner of making an element of a nunchaku requires additional machining operations and may also result in a nunchaku having less than the desired optimum properties. The present invention, described below, substantially eliminates these disadvantages.

In accordance with the principles of this invention each handle member or element of a nunchaku is formed of two parts, one being a plastic insert and the other being a body portion which forms the balance of the structure of the nunchaku, the body portion being molded about the plastic insert. By employing differing forms of materials the elements of the nunchaku can be constructed of materials having more suitable characteristics for each of its component parts than if only a single material were employed. Thus, in the practice of this invention the plastic insert is made of a relatively hard plastic having good wearing characteristics so that the cord which passes through the longitudinally extending aperture 20 will not unduly wear the surface about the aperture. Furthermore, it is essential that the portion 26 of the plastic insert which lies between the apertures 16 and 18 and the grooves 24 be, relatively speaking, quite strong so that this portion 26 does not distort or break during the use of the nunchaku. In this connection it should be observed that very high forces may be exerted upon the portion 26 by the cord 14 pulling in a direction from the portion 26 towards the end 22 of the element. The balance of the structure of each of the elements of the nunchaku should be capable of withstanding very high impacts without shattering. In addition, the balance of the structure should have good solvent resistance so that the surface of the remainder of the body portion does not become corroded from body oils or the like.

It has been found that such a nunchaku can be constructed by utilizing nylon 6/6 in the plastic insert and high density polypropylene for the remainder of the body portion of each of the elements. Thus, high density polypropylene, which has a lower melt temperature than nylon 6/6, can be injection molded about a nylon insert.

Figure 5:
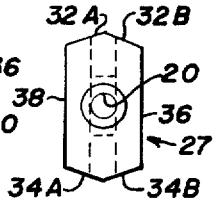
Figure 6:
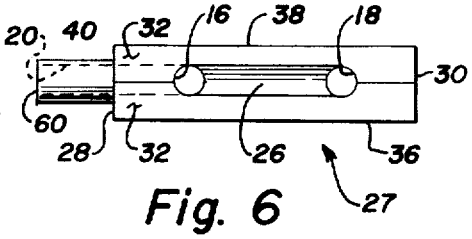

In a preferred embodiment which is shown in the accompanying drawings, the plastic insert, which is generally indicated at 27, is provided with first and second opposed end surfaces 28, 30, respectively, opposed exterior sidewalls 32, 34, and opposed interior sidewalls 36, 38. The exposed exterior sidewalls 32, 34 extend between the first and second end surfaces 28, 30 and are called exterior sidewalls as these sidewalls are exposed when the principal body portion of the structure of the element has been molded about the plastic insert. The opposed interior sidewalls extend between the exterior sidewalls 32, 34 and the first and second end surfaces 28, 30 and are called interior sidewalls as these surfaces are disposed within the interior structure of the element of the nunchaku when the principal body portion has been molded about the plastic insert 27. Each of the exterior sidewalls 32, 34 is formed principally of two intersecting surfaces **32*a*, 32*b* or 34*a*, 34*b* as can best be seen from FIG. 5. The plastic insert 27 is also provided with a generally cylindrical extension which extends away from the first end surface 28, the generally cylindrical extension 40 being generally concentric with the axis of the element 12. The extension 40 may be tubular as shown in the various Figures, or alternatively it may be solid. If it is solid it must subsequently be drilled to provide it with the longitudinally extending aperture 20. The plastic insert is provided with parallel apertures 16, 18 which extend from one of the opposed exterior sidewalls 32 to the other opposed exterior sidewall 34. In addition the plastic insert 27 is provided with a pair of opposed grooves 24 each of which extends from one end of one of the parallel apertures 16, 18 to the associated end of the other of the parallel apertures 16, 18.**

The plastic insert 27 is formed by injection molding in a suitable mold so that parallel apertures 16, 18 and grooves 24 are molded within the insert. The mold may also be so designed so that the longitudinally extending aperture 22 is also simultaneously molded within the plastic insert, however, the mold for the plastic insert may be so designed so that the longitudinally extending aperture 20 is formed by a subsequent machining operation.

In accordance with the principles of this invention the nylon insert 27 is imbedded within one end of a principal body portion, indicated generally at 42, which is molded about the plastic insert.

Figure 7:
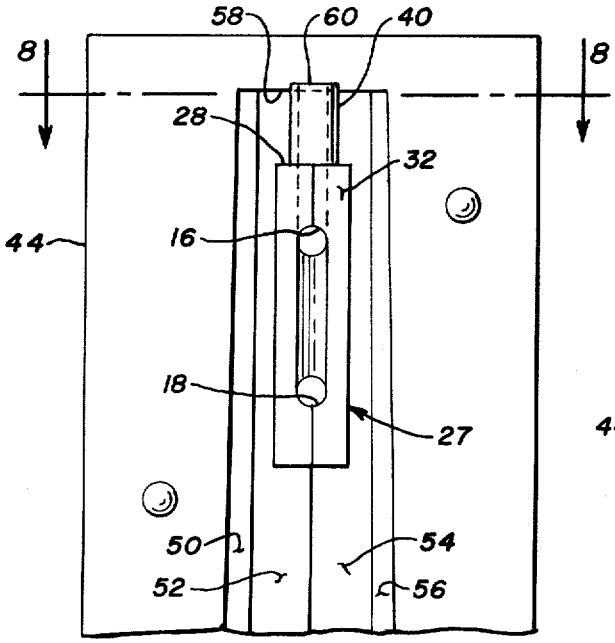
FIG. 7 is a view of a portion of a mold half having a cavity which has received the plastic insert shown in FIGS. 4 through 6.
Figure 8:
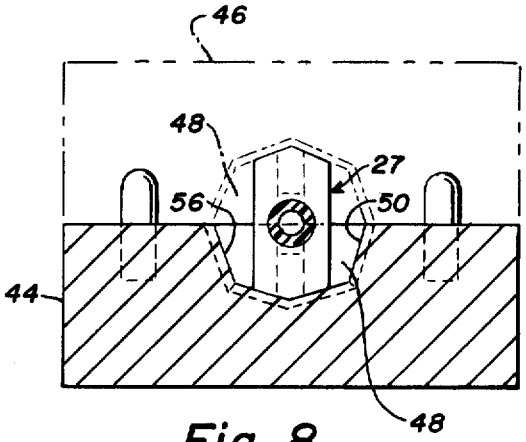
FIG. 8 is a sectional view taken generally along the line 8 — 8 in FIG. 7, another mold half being shown in phantom lines.

The manner of making the element of the nunchaku will now be described. However, it should first be observed that the element is preferable octagonal in cross-section. When molding the element of the nunchaku two mold halves will be employed, one of the mold halves being shown in section in FIG. 8, and the other mold half 46 being shown in phantom lines in FIG. 8. Each of the mold halves is provided with a mold cavity 48. The mold cavities are so designed that when the two mold halves 44, 46 are in their mating, closed, operative position, somewhat schematically illustrated in FIG. 8, the mold cavities will define the shape of the structure of the element 12. Each of the mold cavities is defined by four of the eight sides which define the octagonal surface of the element 12. Thus, each mold cavity is provided with surfaces 50, 52, 54, and 56. The sidewall surfaces **32*a*, 32*b* and 34*a*, 34*b* of the insert 27 correspond in part to the surfaces 52, 54. The insert 27 is placed within one of the mold halves with either the surfaces 32*a*, 32*b* or the surfaces 34*a*, 34*b* in contact with the surfaces 52, 54, the intersecting surfaces 52, 54 cooperating with the surfaces of the exterior sidewall of the insert 27 to position the insert. The end of the cylindrical extension 40 remote from the first end surface 28 may either abut against a vertical wall 58** of the mold, or be disposed within a semi-cylindrical cutout portion (no number) in the manner shown in FIG. 7. The initial positioning of the insert is done when the mold halves are in their open inoperative position. The mold halves are then moved from their open position to their closed position schematically illustrated in FIG. 8. When the mold halves are in their closed position the plastic insert 27 will be firmly clamped in its desired position by the intersecting surfaces 52, 54 of each of the mold cavities. High density polypropylene is then injection molded into the mold cavity 48 to form the principal body portion, the polypropylene flowing about the interior sidewalls 36, 38 of the plastic insert, about the first and second end surfaces 28, 30, and also about the surface of the generally cylindrical extension 40 (with the exception of the end 60 which is remote from the first end surface 28). In this manner the plastic insert is imbedded within the principal body portion with the exception of the oppesed exterior sidewalls 32, 34 and the end 60 of the cylindrical extension 40.

If the generally cylindrical extension 40 was initially provided with the longitudinally extending aperture 20, the element of the nunchaku is now complete. However, if the cylindrical extension were not provided with the aperture 20, it is necessary to drill out this aperture to complete the element. The elements are then threaded together by the cord 14 in a conventional manner to complete the nunchaku.

While a preferred mode of forming a molded element of a nunchaku is set forth above in addition to a disclosure of the element made in accordance with the preferred mode of the invention, it is to be understood that various other alternative modes could be employed in the practice of this invention and that the invention is not to be limited to the particular details, shown and described above, but that, in fact, widely differing means may be employed in the practice of the broader aspects of this invention.

What is claimed is:

1. A handle member a nunchaku, said handle member comprising:

an insert having first and second end surfaces, opposed exterior sidewalls extending between said opposed end surfaces, opposed interior sidewalls extending between said opposed end surfaces and said opposed exterior sidewalls, and a tubular portion which extends away from said first end surface, said insert further being provided with a pair of generally parallel spaced apart apertures extending through said insert from one of the exterior sidewalls to the other exterior sidewall; and an elongated generally cylindrical principal body portion molded about said insert and extending away from the second end surface of said insert, said principal body portion being formed of a plastic having a lower melt temperature than said insert, the parts being so arranged and constructed that the exterior sidewalls of said insert and the end of the tubular portion remote from the first end surface of the insert are exposed.

2. The handle member set forth in claim 1 wherein said principal body portion is formed of a plastic having better impact resistance than said plastic insert.

3. The handle member set forth in claim 1 wherein said plastic insert has better wear characteristic than said principal body portion.

4. The handle member set forth in claim 1 wherein said plastic insert is provided with a groove in each of its exterior sidewalls extending between associated ends of the pair of spaced apart apertures.

5. The handle member set forth in claim 4 wherein said plastic insert is formed of nylon 6/6 and said principal body portion is formed of high density polypropylene.

* * * * *